United States Patent [19]

Fodor et al.

[11] 4,431,553

[45] Feb. 14, 1984

[54] LUBRICANT COMPOSITION CONTAINING METAL OXYQUINOLINATE

[75] Inventors: József Fodor; György Kolimár, both of Budapest; Gizella M. Szilasi, Érd; Margit B. Balog, Budapest, all of Hungary

[73] Assignee: Autoipari Kutató Intézet, Budapest, Hungary

[21] Appl. No.: 333,417

[22] Filed: Dec. 22, 1981

[30] Foreign Application Priority Data

Dec. 30, 1980 [HU] Hungary ..... 3152

[51] Int. Cl.[3] ..... C10M 1/54

[52] U.S. Cl. ..... 252/42.7; 252/74

[58] Field of Search ..... 252/42.7, 74

[56] References Cited

U.S. PATENT DOCUMENTS

| | | | |
|---|---|---|---|
| 2,197,833 | 4/1940 | Reiff | 252/42.7 |
| 2,242,624 | 5/1941 | Schulze et al. | 252/42.7 X |
| 2,281,401 | 4/1942 | Wilson | 252/32 |
| 2,361,804 | 10/1944 | Wilson | 252/33 |
| 2,805,233 | 9/1957 | Bell, Jr. | 252/42.7 |
| 3,307,970 | 3/1967 | Grier | 252/42.7 |

*Primary Examiner*—Andrew Metz

*Attorney, Agent, or Firm*—Keil & Witherspoon

[57] ABSTRACT

The invention relates to a lubricant composition, the carrier material of which is a grease, a lubricating oil, a hydraulic oil or a cutting lubricant of natural and/or synthetic origin and as additive it contains 0.1 to 10 percent by weight of copper, tin and/or lead in the form of copper oxyquinolinate, tin oxyquinolinate and/or lead oxyquinolinate.

The lubricant composition forms a plastic copper, tin and/or lead layer on the surfaces to be lubricated and ensures good frictional properties.

7 Claims, No Drawings

LUBRICANT COMPOSITION CONTAINING METAL OXYQUINOLINATE

The invention relates to a lubricant composition which contains about 90 percent by weight of grease, lubricating oil, hydraulic oil or cutting lubricant as carrier material and the rest of it contains at least one of the compounds chosen from the group consisting of certain organic copper-, tin- and lead-compounds. The copper, tin and lead form a thin metal layer of high plasticity on the surface of the metal parts to be lubricated, said metal part having a lower value of electropositivity than Cu, Sn and Pb, thus improving the abrasive and frictional properties and increasing the resistance to seizure of the metal parts.

The improvement of the abrasive resistance of machines can be ensured by different methods which can be classified into two main groups. The methods of one of these groups can be characterized by the shaping of suitable constructions and by the use of up-to-date manufacturing processes (e.g. suitable structural quality of the metals, accuracy to gauge, conformity, evennes of the surface, surface treatment, heat treatment, thermochemical treatment etc.). The other group of the different methods, where present invention belongs to, is connected with the influencing of the working conditions of the machines and with the expedient employment of the tribological knowledge and tribotechnical materials and processes.

It was the knowledge of tribological processes that led to the use of additives improving the frictional properties by mixing them into the lubricants. A group of the non-soluble additives, depending on their structure, exert their effect mechanically in such a manner that they prevent the direct contact between the two surfaces subjected to abrasion (hereinafter: "abrasive couple") by forming a third, well-sliding intersurface between the surfaces of the abrasive couple. Substances as typical representatives of this mechanism are the molybdene sulfide and the teflon.

Another group of the non-soluble additives consists of metal containing additives which, in case of appropriate lubricating and frictional conditions, form a metal layer on the surfaces of the abrasive couple as a result of physical-chemical processes and the precipitated metal layer through its good sliding properties improves the frictional conditions and increases the loading resistance of the surfaces. Lubricants and greases containing mainly cuproxide have been prepared on the basis of the above recognition. The metal coating mentioned above can also be formed, in case of appropriate lubricating system (e.g. in case of brass/broze-steel abrasive couple), without any extra additives. In such cases the additive is provided by the abrasive particles breaking off from the copper containing surface. The plasticity of the thin metal layer formed (e.g. the Cu layer is extremely plastic) does not change during the friction and it works just like a viscous lubricant.

According to the literature sources, the formation of the metal layer having high plasticity is a time-consuming process; during operation at least a half an hour is required to the proceedings of the physical and chemical processes resulting in the precipitation of the metal. During the frictional motion the metal particles or ions by breaking off or reduction get onto the metal surface from the lubricant and there they get incorporated.

The object of the invention is to provide such a lubricant composition in which the plastic metal layer precipitating on the metal surface subjected to friction is already present at the beginning of the operation, independently from the frictional motion during operation and the operational conditions.

The invention is based on the recognition that copper, tin and lead ensuring good frictional properties also precipitate from their compounds formed with oxyquinoline onto the surface of the iron-metals or iron-metal alloys in standstill, without frictional motion or heat-effect. The precipitation is due to the difference in the electrode potential of the metals. In addition, the precipitation of the metal forming the coating is continuous during operation and in frictional conditions, too.

The subject of the invention is a lubricant composition, the carrier material of which is a grease, a lubricating oil, a hydraulic oil or a cutting lubricant of natural and/or synthetic origin and as additive it contains 0.1 to 10 percent by weight of copper, tin and/or lead in the form of copper oxyquinolinate, tin oxyquinolinate and/or lead oxyquinolinate.

The preferred amounts of the metals in the compositions of the invention in case of the different carriers are as follows:

0.2 to 10 percent by weight in greases,
0.1 to 7 percent by weight in lubricating oils,
0.1 to 5 percent by weight in hydraulic oils, and
0.2 to 7 percent by weight in cutting lubricants.

The additives of the invention can be advantageously mixed with all kinds of greases, lubricating oils, hydraulic oils and cutting lubricants.

The field of application of the lubricant compositions of the invention is as follows: motor oils; compressor oils; gear oils; liquids used for the operation of hydraulic equipments, e.g. hydraulic oils, shock absorber liquids and brake fluids; liquids used for the operation of hydraulical gears having specific tooth cutting; every kind of greases used for lubricating roller bearings, steering gears, ball joints and other machinery elements; furthermore, such cutting lubricants which are streaming on sliding-frictioning surfaces during operation. The addition of the compositions of the invention to cutting lubricants of cutting tools results in increased working life.

We have found that the compositions of the invention also exert noise-reducing effect when used for lubricating gears.

Further advantage of the additives of the invention is their easy and cheap availability.

The following examples illustrate the invention without limiting its scope.

EXAMPLE 1

To 787.9 g of grease consisting of mineral oil products (LZS; lithium based grease; produced by Komaromi Kőolajipari Vállalat, Komárom, Hungary) 221.3 g of copper oxyquinolinate ($CuC_{18}H_{12}O_2N_2$) are added. The copper content of the copper oxyquinolinate is 40 g. The lubricant composition obtained contains 4 percent by weight of copper.

EXAMPLE 2

To 723.38 g of lubricating oil consisting of mineral oil products (MSE; produced by Komáromi Kőolajipari Vállalat, Komárom, Hungary) 276.26 g of copper oxyquinilinate are added. The copper content of the copper oxyquinolinate is 50 g. The lubricating composition obtained contains 5 percent by weight of copper.

EXAMPLE 3

To 972.34 g of hydraulic oil consisting of mineral oil products (Hykomol; produced by Komáromi Kőolajipari Vállalat, Komárom, Hungary) 27.66 g of copper oxyquinolinate are added. The copper content of the copper oxyquinolinate is 5 g. The lubricating composition obtained contains 0.5 percent by weight of copper.

EXAMPLE 4

To 889.35 g of cutting lubricant consixting of a mixture of mineral oil products and water 110.65 g of copper oxyquinolinate are added. The copper content of the copper oxyquinolinate is 20 g. The lubricating composition obtained contains 2 percent by weight of copper.

EXAMPLE 5

To 904.38 g of grease (the same as used in Example 1) 95.62 g of lead oxyquinolinate are added. The lead content of the lead oxyquinolinate is 40 g. The lubricating composition obtained contains 4 percent by weight of lead.

EXAMPLE 6

To 843.6 g of lubricating oil (the same as used in Example 2) 36.65 g of copper oxyquinolinate and 119.67 g of lead oxyquinolinate are added. The total metal content of the copper and lead oxyquinolinates amounts to 50 g. The lubricant composition obtained 1.17 percent by weight of copper and 3.83 percent by weight of lead.

EXAMPLE 7

To 871.23 g of grease (the same as used in Example 1) 21 g of copper oxyquinolinate, 68.5 g of lead oxyquinolinate and 39.24 g of tin oxyquinolinate are added. The total metal content of the oxyquinolinates amounts to 40 g. The grease composition obtained contains 0.65 percent by weight of copper, 2.13 percent by weight of lead and 1.22 percent by weight of tin.

We claim:

1. A lubricant which comprises natural grease, synthetic grease, mixtures of natural and synthetic grease, lubricating oil, hydraulic oil or cutting oil and from 0.1 to 10% by weight of copper, tin, lead or mixtures thereof in the form of copper oxyquinolinate, tin oxyquinolinate lead oxyquinolinate or mixtures thereof.

2. The composition of claim 1, characterized in that it contains 0.2 to 5 percent by weight of copper, tin and/or lead in the form of copper oxyquinolinate, tin oxyquinolinate, lead oxyquinolinate or mixtures thereof.

3. The composition of claim 1, characterized in that it contains 0.2 to 5 percent by weight of copper in the form of copper oxyquinolinate.

4. The composition of claim 1, wherein the lubricant is a natural or synthetic grease and the amount of copper, tin and/or lead is from 0.2 to 10% by weight.

5. The composition of claim 1, wherein the lubricant is a lubricating oil and the amount of copper, tin and/or lead is from 0.1 to 7% by weight.

6. The composition of claim 1, wherein the lubricant is a hydraulic oil and the amount of copper, tin and/or lead is from 0.1 to 5% by weight.

7. The composition of claim 1, wherein the lubricant is a cutting oil and the amount of copper, tin and/or lead is from 0.2 to 7% by weight.

* * * * *